United States Patent [19]

Hoffmann

[11] 4,391,394

[45] Jul. 5, 1983

[54] METHOD FOR LAYING SHIRTS, ESPECIALLY MEN'S SHIRTS, FOR PURPOSES OF WRAPPING

[75] Inventor: Rolf Hoffmann, Monchen-Gladbach, Fed. Rep. of Germany

[73] Assignee: van Laack, Schmitz & Eltschig GmbH u. Co., Monchen-Gladbach, Fed. Rep. of Germany

[21] Appl. No.: 226,100

[22] Filed: Jan. 19, 1981

[30] Foreign Application Priority Data

Sep. 26, 1980 [DE] Fed. Rep. of Germany ..... 3036277

[51] Int. Cl.[3] ..... A41H 33/00

[52] U.S. Cl. ..... 223/37

[58] Field of Search ..... 223/37

[56] References Cited

U.S. PATENT DOCUMENTS

| | | | |
|---|---|---|---|
| 2,028,658 | 1/1936 | Gray | 223/37 |
| 3,869,073 | 3/1975 | Knappe et al. | 223/37 |
| 3,891,129 | 6/1975 | Knappe et al. | 223/37 |

FOREIGN PATENT DOCUMENTS

| | | | |
|---|---|---|---|
| 2282014 | 4/1976 | France | 223/37 |
| 642144 | 7/1962 | Italy | 223/37 |

*Primary Examiner*—Louis Rimrodt

*Attorney, Agent, or Firm*—Shlesinger, Arkwright, Garvey & Dinsmore

[57] ABSTRACT

A method for laying a shirt, comprising the steps of folding a first shirt yoke and a second shirt yoke along mutually parallel folding lines; laying said first folded yoke on said shirt back and on said second yoke; fastening said first shift yoke to said second shirt yoke with a clamp positioned in the area of a beak formed by said first folded shirt yoke and said second folded shirt yoke; laying a first shirt sleeve and a second shirt sleeve on said fastened yokes respectively; folding said shirt torso end along a folding line extending transversely to said mutually parallel folding lines and at a distance from said shirt collar; fastening said torso end to said shirt by means of at least a first pin and a second pin located at a distance from said shirt collar; folding said torso end along said first shirt yoke and said second shirt yoke; and, tucking said torso behind said first folded shirt yoke and said second folded shirt yoke.

6 Claims, 5 Drawing Figures

METHOD FOR LAYING SHIRTS, ESPECIALLY MEN'S SHIRTS, FOR PURPOSES OF WRAPPING

The invention relates to a method for laying shirts, especially men's shirts, for wrapping purposes, whereby the shirt yokes are folded-over along mutually parallel folding lines onto the back of the shirt and are then fastened, whereupon the shirt sleeves are laid on the turned-over yokes and next the end of the torso consisting of front and back which is away from the collar is turned over together with its already folded parts along a folding line which is parallel to the lengthwise direction of the shirt and is pinned with at least two pins at the front side or at the adjoining parts that were turned over.

As regards a method of the known species and known in practice, the shirt is placed with its front side on a folding table and is pulled or manually smoothed. A reinforcing cardboard is placed on the backside of the shirt; this cardboard comprises a cut essentially corresponding to the shape of the folded, i.e. the wrapped shirt. A stiffening strip to be slipped underneath the shirt collar may additionally join the reinforcing cardboard. The stiffening strip however may be an independent part. After the stiffening means are put in place, the shirt yokes are folded over along mutually parallel folding lines defined by the side edges of the stiffening insert, and are pinned both together and to the insert. The sleeves are then laid on the turned-over parts so formed and may be further fixed by pins. Thereupon the lower end of the torso consisting of front and back together with the turned-over parts already formed are folded and turned over about a transverse folding line, whereby the folding line of the folded set essentially terminates at the upper end of the yokes. The folded-over end of the torso is then pinned in the area of the folded-over parts' ends at the yokes and/or inserts. The shirt so folded and laid then is placed into a wrapping bag, especially made of transparent foil, and it will also be sold in this condition.

The purchaser or user removes the shirt from the wrap and must remove the pins before the shirt can be unfolded. As the pins however usually are so arranged for optical reasons they are mostly out of sight externally, it is not clear at the outset how many pins must be removed before the shirt can be unfolded. Conventional methods require at least six to eight pins to keep the shirt in the folded state. If the purchaser or user does not find, or overlooks one or more of the pins, same remain(s) in the shirt and accordingly may cause injuries later when the shirt is put on or worn.

It is the object of the invention to provide a method of the initially cited species whereby a shirt can be so laid together using a lesser number of pins that it forms a stable and durable sales unit.

This object is resolved in that the folded-over and superposed yokes in the area within a beak they subtend are mutually fastened together by a slipped-on clip and that the torso is turned over to such an extent that an end of the slipped-in shirt part projecting beyond the upper yoke edges remains which is then folded around these yoke edges and pinned behind the yokes.

Two pins suffice in the laying of a shirt by the method of the invention to keep the shirt folded as one sales unit in a stable state. Additionally merely one clip is required to mutually fasten the two folded-over yokes. The method of the invention is so carried out that care is taken for every phase of the folding, or laying, that the laid or folded segments no longer can displace with respect to each other. It should be understood that the inserts of the conventional kind can also be used in the method of the invention because these inserts define in simple manner the folding lines to be formed for turning over the yokes. Moreover these inserts make it possible to pull smooth especially the front side which is visible in the sales wrap.

In any event it is enough that the turned-over and superposed yokes be mutually fastened in the area within a beak formed by them by a clip which is slipped on them. This fastening means simultaneously achieves the implementation of a common support by means of the upper edges of the turned-over yokes for the inserted end of the folded-over part torso part, whereby same is fixed to said end and requires no more than being fixed by two additional pins on each side approximately halfway between the upper edge of the folded-over yoke and the transverse folding line—which also can be defined by the insert.

As these two pins are only placed in position after the lower torso part has been turned over—the lower torso part as a rule then forming the upper side of the shirt placed on the folding table—the two pins therefore can then be inserted without difficulty in such a manner that they remain out of sight in the sales wrap but are visible when turning the wrap around and are easily removable.

As regards the method of the species initially described, the arms frequently are so laid that at least one cuff with its sewed-on cull seam is arranged essentially parallel to the longitudinal folding lines and outside the fold, this cuff lastly being turned over on the front side of the folded shirt and being fastened there. It is advantageous in such an implementation that at least one of the two pins to fasten the turned-over torso be so arranged in the area of the sleeve joined to the cuff and outside the fold that the sleeve too will be fixed.

Thereupon the cuff can be folded over on the front side of the shirt and be fixed by means of a clip of which one side is slipped into the cuff slit and over the front side of the shirt, and of which the other end is slipped under the joining sleeve. The clip then is no longer visible as it disappears in the cuff slit, and it does not degrade the aesthetic appearance of the sales wrap.

As illustrative implementation of the invention is discussed in further detail below in relation to the drawing.

Figure 1:
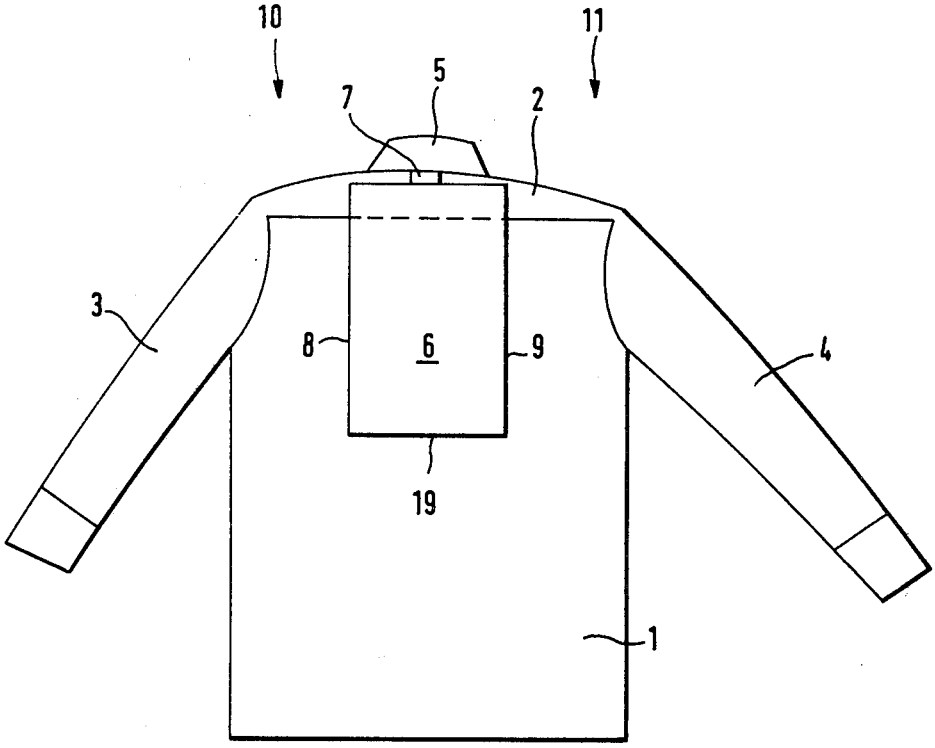
FIG. 1 is the backside of a shirt laid out on an omitted folding table.

The shirt shown in the drawing shall be so laid and folded together that it can be slipped into a conventional clear foil wrap and be ready for sale.

The shirt visible from the back shown in FIG. 1 in its basic form consists of a torso part 1 with yoke 2 and joining sleeves 3, 4 and collar 5. The shirt is laid out in the manner shown on a folding table, the front side of the shirt facing said table. A substantially rectangular stiffening insert 6 then is laid on the back side of the shirt in the region between yoke 2 and torso part 2, said insert typically being cardboard and provided at the upper edge with an extension 7 connecting to a reinforcing strip slipped underneath the collar 5.

Figure 2:
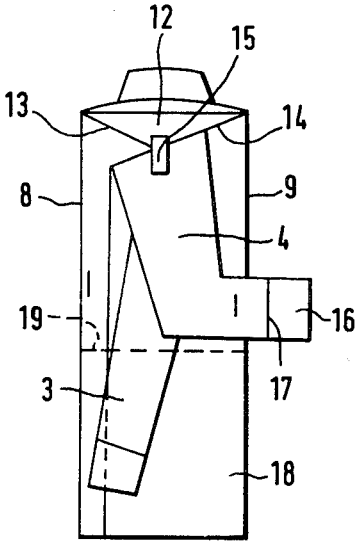
FIG. 2 is the object of FIG. 1 after the yokes have been turned over and the sleeves have been laid.

The two longitudinal sides of the stiffening insert 6 define folding lines 8, 9 about which the associated lateral segments 10, 11 of the yoke 2 and of the torso part 1 are so folded back on the stiffening insert 6 that the two segments of the yoke 2 are superposed while forming a beak 12. Thereupon a clip 15 is slipped over the two upper edges 13, 14 of the superposed yoke segments that thereby are held together (FIG. 2).

The sleeves are laid in such a manner that the sleeve 3 essentially extends in the longitudinal direction of the folded shirt, while the sleeve 4—which forms the upper side of the fold—is so laid that its cuff 16 will be outside the fold and its cuff seam 17 essentially extends parallel to the folding line 9.

Figure 3:
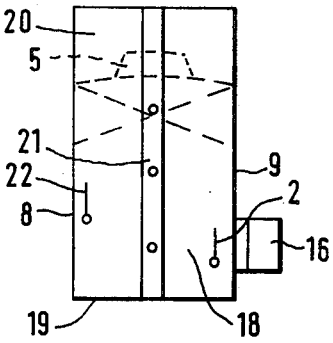
FIG. 3 is the object of FIG. 2 after the lower torso part has been folded over together with the previously turned-over parts, and with sleeves.

Thereupon a lower segment of the torso part with the turned-over sections on it are folded over about a folding line 19 defined by the short side of the stiffening insert 6 which is so sized that the segment 18 is longer than the residual part of the shirt on the folding table. Accordingly the turned over segment 18 extends by one slip-in end 20 beyond the collar 5 (FIG. 3). Hence the shirt front side will be on top of the fold and the bottom strip 21 can be seen.

Thereupon two pins 22, 23 are passed from above and next to the folding lines 8, 9 through the turned over segment 18 and the folded-over segments therebelow for the purpose of ficing the segment 18 to the layers underneath it. The pin 23 is so arranged that it also fixes the sleeve 4 of which the cuff 16 lies next to the folded assembly.

Figure 4:
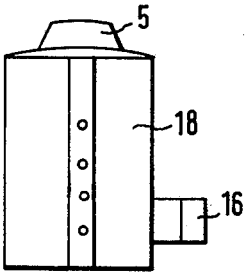
FIG. 4 is the object of FIG. 3 after the turned-over torso part end was slipped behind the superposed yokes.

Next the slip-in end 20 of the turned-over segment is folded over the upper edges 13, 14 of the folded yoke segments and slipped into the opening in the area of the beak 20 formed between the turned-over yoke segments and the shirt back (FIG. 4).

Figure 5:
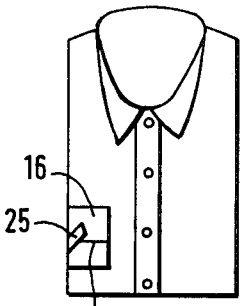
FIG. 5 is the front side of the object of FIG. 4 after the cuff was turned over and fixed.

The shirt now is turned around (FIG. 5) and the cuff 16 is turned over on the front side of the shirt and fixed in place by means of a clip 25 inserted in the cuff slit 24. The clip 25 is introduced in such a manner in the cuff slit 24 that one of its end passes over the front side of the shirt and its other end below the adjoining sleeve and hence below the turned-over segment 11.

It should be clear that the individual segments of the shirt are smoothed when laid and folded. Parts which are already laid and fixed in place by clips and/or pins are no longer capable of displacement and remain smooth, so that the shirt folded in accordance with the invention can be slipped into a clear wrap and be offered for sale. Neither pins or clips are visible in the clear wrap. After the shirt is removed from the wrap, only the two pins 22, 23—which are visible from the rear—need be removed. The clips 15 or 25 practically open up by themselves when the shirt is unfolded.

I claim:

1. A procedure for laying a shirt, in particular a men's shirt, for purposes of wrapping, wherein the shirt yokes are folded-over along mutually parallel folding lines on the back of the shirt and the folded-over yokes lying on each other are fastened by a slipped-on clamp in the area of a beak formed between them, whereupon the shirt sleeves are layed on the folded-over yokes and then the torso end consisting of the front and rear sides and away from the collar is turned-over together with folded-over parts along a folding line extending transversely to the lengthwise direction of the shirt and is further fastened to the front side or to the folded-over parts joining same, characterized in that the folded-over yokes (2, 10, 11) are merely joined together by the clamp (15), in that the folded-over torso end (18) of the shirt (1) that is away from the collar is fastened by at least two pins (22, 23) to the folded-over parts (10, 11), and in that torso end (18) is folded-over so much that a tuck-in end (20) projecting above the upper border (13, 14) is folded about this border (13, 14) of the yokes (2) and is tucked-in behind the yokes (2, 10, 11).

2. Method per claim 1, characterized in that the two pins (22, 23) to fix the turned-over torso (18) are mounted about halfway between the upper edge (13, 14) of the yokes and the transverse folding line (19) of the turned-over torso (18).

3. Method per claim 1 or 2, wherein the sleeves are so laid that at least one cuff with its sewn-on cuff seam is arranged essentially parallel to the longitudinal folding lines, characterized in that at least one of the two pins (23) for fixing the turned-over torso (18) is so mounted in the area of the sleeve (4) joining the cuff (16) which is outside, that the sleeve (4) also is fixed.

4. Method per claim 3, characterized in that the cuff (16) is turned over onto the shirt front side and is fixed into place by a clip (25) of which one end is slipped into the cuff slit (24) and over the front side of the shirt, and of which the other end if slipped under the adjoining sleeve (4).

5. A method for laying a shirt, comprising the steps of:

a. folding a first shirt yoke and a second shirt yoke along mutually parallel folding lines;
b. laying said first folded yoke on said shirt back and on said second yoke;
c. fastening said first shirt yoke to said second shirt yoke with a clamp positioned in the area of a beak formed by said first folded shirt yoke and said second folded shirt yoke;
d. laying a first shirt sleeve and a second shirt sleeve on said fastened yokes respectively;
e. folding said shirt torso end along a folding line extending transversely to said mutually parallel folding lines and at a distance from said shirt collar;
f. fastening said torso end to said shirt by means of at least a first pin and a second pin located at a distance from said shirt collar;
g. folding said torso end along said first shirt yoke and said second shirt yoke; and,
h. tucking said torso behind said first folded shirt yoke and said second folded shirt yoke.

6. A method of folding a shirt as defined in claim 5, further comprising:

a. placing a substantially rigid rectangular support member on said back as a means for defining said mutually parallel folding lines and supporting said yokes.

* * * * *